US008344982B2

(12) United States Patent
Senda

(10) Patent No.: US 8,344,982 B2
(45) Date of Patent: Jan. 1, 2013

(54) CURRENT-DRIVEN DISPLAY DEVICE

(75) Inventor: Takahiro Senda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 239 days.

(21) Appl. No.: 12/452,758

(22) PCT Filed: Jun. 23, 2008

(86) PCT No.: PCT/JP2008/061393

§ 371 (c)(1),
(2), (4) Date: Jan. 21, 2010

(87) PCT Pub. No.: WO2009/050923

PCT Pub. Date: Apr. 23, 2009

(65) Prior Publication Data

US 2010/0118059 A1 May 13, 2010

(30) Foreign Application Priority Data

Oct. 18, 2007 (JP) ..... 2007-270832

(51) Int. Cl.
*G09G 3/36* (2006.01)

(52) U.S. Cl. ..... 345/92; 345/76; 345/82

(58) Field of Classification Search ..... 345/76–92, 345/690

See application file for complete search history.

(56) References Cited

U.S. PATENT DOCUMENTS

| | | | | |
|---|---|---|---|---|
| 2004/0070557 | A1 | 4/2004 | Asano et al. | |
| 2004/0100427 | A1 * | 5/2004 | Miyazawa | 345/76 |
| 2005/0110730 | A1 | 5/2005 | Kim et al. | |
| 2005/0140600 | A1 | 6/2005 | Kim et al. | |
| 2005/0219170 | A1 | 10/2005 | Seki | |
| 2006/0022305 | A1 | 2/2006 | Yamashita | |
| 2006/0044236 | A1 * | 3/2006 | Kim | 345/82 |
| 2007/0040769 | A1 | 2/2007 | Tai et al. | |
| 2007/0103406 | A1 | 5/2007 | Kim | |
| 2007/0124633 | A1 * | 5/2007 | Kim | 714/726 |
| 2007/0146247 | A1 | 6/2007 | Huang et al. | |
| 2007/0262931 | A1 | 11/2007 | Peng et al. | |

FOREIGN PATENT DOCUMENTS

| | | |
|---|---|---|
| JP | 2004-133240 | 4/2004 |
| JP | 2005-157244 | 6/2005 |
| JP | 2005-157308 | 6/2005 |
| JP | 2005-234063 | 9/2005 |
| JP | 2005-292272 | 10/2005 |
| JP | 2005-292436 | 10/2005 |

(Continued)

*Primary Examiner* — Amare Mengistu
*Assistant Examiner* — Premal Patel
(74) *Attorney, Agent, or Firm* — Harness, Dickey & Pierce, P.L.C.

(57) ABSTRACT

In one embodiment of the present invention, to allow a circuit that compensates for variations in a threshold voltage of a drive element to operate properly and prevent luminances of other pixel circuits from fluctuating due to a compensation operation, a pixel circuit is disclosed. A driving TFT, a switching TFT, and an organic EL element are provided between a power supply wiring line and a common cathode, and a capacitor and a switching TFT are provided between a gate terminal of the driving TFT and a data line. A switching TFT is provided between a connection point B between the capacitor and the switching TFT and a reference supply wiring line, a switching TFT is provided between the gate terminal and a drain terminal of the driving TFT, and a switching TFT is provided between the gate terminal of the driving TFT and the connection point B.

7 Claims, 6 Drawing Sheets

FOREIGN PATENT DOCUMENTS

| | | |
|---|---|---|
| JP | 2006-078911 | 3/2006 |
| JP | 2006-349794 | 12/2006 |
| JP | 2007-114426 | 5/2007 |
| JP | 2007-133369 | 5/2007 |
| JP | 2007-304594 | 11/2007 |

* cited by examiner

CURRENT-DRIVEN DISPLAY DEVICE

TECHNICAL FIELD

The present invention relates to a display device and more particularly to a current-driven display device such as an organic EL display.

BACKGROUND ART

In recent years, there has been an increasing demand for thin, lightweight, and fast response display devices. Along with this, research and development for organic EL (Electro Luminescence) displays and FEDs (Field Emission Displays) have been actively conducted. The luminance of an organic EL element included in an organic EL display is substantially proportional to a current flowing through the element and is less susceptible to external factors such as an ambient temperature. Thus, for organic EL displays, it is preferred to apply a current control type drive scheme in which the luminance of an organic EL element is determined by a current value.

Meanwhile, pixel circuits and drive circuits of a display device are made using TFTs (Thin Film Transistors) made of amorphous silicon, low-temperature polycrystal silicon, CG (Continuous Grain) silicon, and the like. A current flowing through a TFT fluctuates depending on the characteristics of the TFT, such as a threshold voltage and mobility, and variations are likely to occur in the threshold voltage and mobility. Hence, it is difficult to make currents flowing through TFTs and an organic EL element match each other between a large number of pixel circuits included in a display. In view of this, a pixel circuit of an organic EL display is provided with a circuit that compensates for variations in the characteristics of a TFT. By the effect of this circuit, variations in the luminance of an organic EL element are suppressed.

Schemes to compensate for variations in the characteristics of a TFT in a current control type drive scheme are broadly divided into a current program scheme in which the amount of current flowing through a driving TFT is controlled by a current signal; and a voltage program scheme in which such an amount of current is controlled by a voltage signal. By using the current program scheme, variations in threshold voltage and mobility can be compensated for, and by using the voltage program scheme, variations in only threshold voltage can be compensated for.

However, the current program scheme has problems. Firstly, since a very small amount of current is handled, it is difficult to design a pixel circuit and a drive circuit. Secondly, since it is susceptible to parasitic capacitance while a current signal is set, it is difficult to achieve an increase in area. On the other hand, in the voltage program scheme, the influence of parasitic capacitance, or the like, is little and a circuit design is relatively simple. In addition, the influence exerted on the amount of current by variations in mobility is smaller than the influence exerted on the amount of current by variations in threshold voltage and the variations in mobility can be suppressed to a certain extent in a TFT fabrication process. Therefore, even a display device to which the voltage program scheme is applied can obtain satisfactory display quality.

For an organic EL display to which a current control type drive scheme is applied, a pixel circuit shown below is conventionally known. FIG. 7 is a circuit diagram of a pixel circuit described in Patent Document 1. A pixel circuit 800 shown in FIG. 7 includes a driving TFT 810, switching TFTs 811 to 814, a capacitor 820, and an organic EL element 830.

The switching TFTs 812 and 814 are of an n-channel type and other TFTs are of a p-channel type.

In the pixel circuit 800, the driving TFT 810, the switching TFT 814, and the organic EL element 830 are provided in series between a power supply wiring line Vp and a common cathode Vcom (their potentials are respectively referred to as VDD and VSS). The capacitor 820 and the switching TFT 811 are provided in series between a gate terminal of the driving TFT 810 and a data line Sj. Hereinafter, a connection point between the driving TFT 810 and the capacitor 820 is referred to as A and a connection point between the capacitor 820 and the switching TFT 811 is referred to as B. The switching TFT 812 is provided between the connection point B and the power supply wiring line Vp, and the switching TFT 813 is provided between the connection point A and a drain terminal of the driving TFT 810. All gate terminals of the respective switching TFTs 811 to 814 are connected to a scanning line Gi.

FIG. 8 is a timing chart of the pixel circuit 800. Before time t0, the potential of the scanning line Gi is controlled to a high level. When at time t0 the potential of the scanning line Gi changes to a low level, the switching TFTs 811 and 813 change to a conducting state and the switching TFTs 812 and 814 change to a non-conducting state. The connection point B is thus disconnected from the power supply wiring line Vp and is connected to the data line Sj through the switching TFT 811. In addition, the gate and drain terminals of the driving TFT 810 reach the same potential. Hence, a current flows into the gate terminal of the driving TFT 810 from the power supply wiring line Vp through the driving TFT 810 and the switching TFT 813, and the potential at the connection point A rises while the driving TFT 810 is in a conducting state. The driving TFT 810 changes to a non-conducting state when the gate-source voltage thereof reaches a threshold voltage Vth (negative value) (i.e., the potential at the connection point A reaches (VDD+Vth)). Therefore, the potential at the connection point A rises to (VDD+Vth).

Then, when at time t1 the potential of the data line Sj changes from a previous data potential Vdata0 (a data potential written to a pixel circuit in a previous row) to a present data potential Vdata, the potential at the connection point B changes to Vdata. Therefore, the voltage between electrodes of the capacitor 820 immediately before time t2 is a potential difference (VDD+Vth−Vdata) between the connection point A and the connection point B.

Then, when at time t2 the potential of the scanning line Gi changes to a high level, the switching TFTs 811 and 813 change to a non-conducting state and the switching TFTs 812 and 814 change to a conducting state. The gate terminal of the driving TFT 810 is thus disconnected from the drain terminal thereof. In addition, the connection point B is disconnected from the data line Sj and is connected to the power supply wiring line Vp through the switching TFT 812. Accordingly, the potential at the connection point B changes from Vdata to VDD and correspondingly the potential at the connection point A changes by the same amount (VDD−Vdata; hereinafter, referred to as VB) and thus reaches (VDD+Vth+VB).

After time t2, since the switching TFT 814 is placed in a conducting state, a current flows through the organic EL element 830 from the power supply wiring line Vp through the driving TFT 810 and the switching TFT 814. The amount of current flowing through the driving TFT 810 increases or decreases depending on the gate terminal potential (VDD+Vth+VB), and even when the threshold voltage Vth is different, if the potential difference VB is the same, then the amount of current is the same. Therefore, regardless of the value of the threshold voltage Vth, an amount of current according to the potential Vdata flows through the organic EL element 830 and thus the organic EL element 830 emits light with a luminance according to the data potential Vdata.

As described above, according to the pixel circuit 800, variations in the threshold voltage of the driving TFT 810 can be compensated for and the organic EL element 830 can emit light with a desired luminance. However, the pixel circuit 800 has a problem that the circuit may not operate properly when variations in the threshold voltage of the driving TFT 810 are compensated for.

For example, when almost no current flows through the driving TFT 810 in a previous frame (when black display is performed), the potential VA at the connection point A at time t0 in FIG. 8 is substantially (VDD+Vth) or higher. When the potential at the connection point B changes from VDD to Vdata during a period from time t0 to time t1, the potential at the connection point A also correspondingly changes. However, since, as described above, Vdata>VDD, if the potential at the connection point B rises from VDD to Vdata when the potential at the connection point A is substantially (VDD+Vth) or higher, then the potential at the connection point A becomes higher than (VDD+Vth). Therefore, the driving TFT 810 maintains a state in which almost no current flows therethrough, and thus, is not placed in a conducting state. In this case, variations in the threshold voltage of the driving TFT 810 cannot be compensated for by the above-described method.

A pixel circuit that solves this problem is also devised. FIG. 9 is a circuit diagram of a pixel circuit described in Patent Document 2. A switching TFT 915 for applying an initialization voltage is added to a pixel circuit 900 shown in FIG. 9. A driving TFT 910, switching TFTs 911 to 914, a capacitor 920, and an organic EL element 930 which are included in the pixel circuit 900 respectively correspond to the driving TFT 810, the switching TFTs 811 to 814, the capacitor 820, and the organic EL element 830 which are included in the pixel circuit 800.

The components (except for the switching TFT 915) of the pixel circuit 900 are comparable to their corresponding components of the pixel circuit 800 and the pixel circuit 900 operates in substantially the same mariner as the pixel circuit 800. Note that, to make a pixel circuit that operates in the same manner as the pixel circuit 800 including TFTs having different polarities, by using only TFTs having the same polarity, two split scanning lines G1*i* and G2*i* are provided in the pixel circuit 900.

In the pixel circuit 900, the switching TFT 915 is provided between an initialization power supply wiring line Vint and a drain terminal of the driving TFT 910, and the switching TFTs 913 and 915 are controlled to a conducting state before starting an operation for compensating for variations in the threshold voltage of the driving TFT 910. In this manner, a potential of the initialization power supply wiring line Vint can be provided to a gate terminal of the driving TFT 910 (connection point A). Hence, by performing an initialization process by providing a potential at which the driving TFT 910 is always placed in a conducting state, to the initialization power supply wiring line Vint, the driving TFT 910 can be set to a conducting state, regardless of a state before initialization. Accordingly, the pixel circuit 900 can operate properly so as to compensate for variations in the threshold voltage of the driving TFT 910, regardless of a previous state thereof.

[Patent Document 1] Japanese Patent Application Laid-Open No. 2005-157308

[Patent Document 2] Japanese Patent Application Laid-Open No. 2007-133369

DISCLOSURE OF THE INVENTION

Problems to be Solved by the Invention

In the pixel circuit 900 shown in FIG. 9, while the switching TFT 915 is in a conducting state, the initialization power supply wiring line Vint and a power supply wiring line Vp are in an electrically connected state through the driving TFT 910 and the switching TFT 915. To place the driving TFT 910 in a conducting state at this time, the potential of the initialization power supply wiring line Vint needs to be lower than (Vp−Vth). Hence, a current flows into the initialization power supply wiring line Vint from the power supply wiring line Vp through the driving TFT 910 and the switching TFT 915. Since in a write-target pixel circuit 900 a current thus flows into an initialization power supply wiring line Vint, the potential of the initialization power supply wiring line Vint locally fluctuates. On the other hand, in other pixel circuits 900, the potential of an initialization power supply wiring line Vint serves to determine a current flowing through an organic EL element 930. Therefore, in the pixel circuits 900 other than the write-target pixel circuit 900, when the potential of the initialization power supply wiring line Vint fluctuates, a current flowing through the organic EL element 930 fluctuates.

In general organic EL displays, by sequentially performing a process of selecting pixel circuits of one row and providing data potentials, write to pixel circuits of all rows is performed. Meanwhile, an initialization process for pixel circuits 900 needs to be performed for each row of pixel circuits. Therefore, in an organic EL display including the pixel circuits 900, since an initialization process is intermittently performed, the potential of an initialization power supply wiring line Vint always fluctuates. Since pixel circuits 900 other than a write-target pixel circuit 900 are always affected by this fluctuation, it is difficult to properly perform image display.

An object of the present invention is therefore to provide a display device that allows a circuit to operate properly when compensating for variations in the threshold voltage of a drive element and that prevents the luminances of other pixel circuits from fluctuating due to a compensation operation performed on a certain pixel circuit.

Means for Solving the Problems

According to a first aspect of the present invention, there is provided a current-driven display device including: a plurality of pixel circuits arranged at respective intersections of a plurality of scanning lines and a plurality of data lines; a scanning signal output circuit that selects a write-target pixel circuit using a corresponding scanning line; and a display signal output circuit that provides a potential according to display data to a corresponding data line, wherein each of the pixel circuits includes: an electro-optical element provided between a first power supply wiring line and a second power supply wiring line; a drive element provided in series with the electro-optical element and between the first power supply wiring line and the second power supply wiring line; a capacitor connected, at a first electrode thereof, to a control terminal of the drive element; a first switching element provided between a second electrode of the capacitor and a corresponding data line; a second switching element provided between the second electrode of the capacitor and a third power supply wiring line; a third switching element provided between the control terminal and one current input/output terminal of the drive element; and a fourth switching element connected, at one end thereof, to the control terminal of the drive element and connected, at the other end thereof, to the second electrode of the capacitor.

According to a second aspect of the present invention, there is provided a current-driven display device including: a plurality of pixel circuits arranged at respective intersections of a plurality of scanning lines and a plurality of data lines; a scanning signal output circuit that selects a write-target pixel circuit using a corresponding scanning line; and a display signal output circuit that provides a potential according to display data to a corresponding data line, wherein each of the pixel circuits includes: an electro-optical element provided between a first power supply wiring line and a second power supply wiring line; a drive element provided in series with the electro-optical element and between the first power supply wiring line and the second power supply wiring line; a capacitor connected, at a first electrode thereof, to a control terminal of the drive element; a first switching element provided between a second electrode of the capacitor and a corresponding data line; a second switching element provided between the second electrode of the capacitor and a third power supply wiring line; a third switching element provided between the control terminal and one current input/output terminal of the drive element; and a fourth switching element connected, at one end thereof, to the control terminal of the drive element and connected, at the other end thereof, to the data line.

According to a third aspect of the present invention, in the first or second aspect of the present invention, in a selected scanning period for the pixel circuit, during a first period, the first and the fourth switching elements are controlled to a conducting state and the second and the third switching elements are controlled to a non-conducting state, then, during a second period, the first and the third switching elements are controlled to a conducting state and the second and the fourth switching elements are controlled to a non-conducting state, and then, during a third period, the first, the third, and the fourth switching elements are controlled to a non-conducting state and the second switching element is controlled to a conducting state.

According to a fourth aspect of the present invention, in the first or second aspect of the present invention, each of the pixel circuits further includes a fifth switching element provided between the drive element and the electro-optical element.

According to a fifth aspect of the present invention, in the first or second aspect of the present invention, during a selected scanning period for the pixel circuit, a potential of the second power supply wiring line is controlled such that a voltage applied to the electro-optical element is lower than a light-emission threshold voltage.

According to a sixth aspect of the present invention, in the first or second aspect of the present invention, a potential at which the drive element can be set to a conducting state and which is constant during a selected scanning period for the pixel circuit is provided to the data line.

According to a seventh aspect of the present invention, in the first or second aspect of the present invention, the electro-optical element is made of an organic EL element.

According to an eighth aspect of the present invention, in the first or second aspect of the present invention, the drive element and all the switching elements in each of the pixel circuits are made of thin-film transistors.

Effects of the Invention

According to the first aspect of the present invention, by applying a potential that places the drive element in a conducting state to the data line and controlling the first and fourth switching elements to a conducting state, a data potential is provided to the control terminal of the drive element and thus the drive element can always be set to a conducting state, regardless of a previous state of the pixel circuit. Hence, at the point in time when the third switching element is controlled to a conducting state, the drive element can be reliably set to a conducting state. Thus, when variations in the threshold voltage of the drive element are compensated for, the circuit can operate properly.

In addition, since the drive element can be initialized with any one of the third and fourth switching elements being maintained in a non-conducting state, the drive element can be initialized without connecting the first and second power supply wiring lines to the third power supply wiring line and thus the potential of the third power supply wiring line can always be stabilized. Furthermore, since initialization of the drive element is performed using the potential of the data line, a power supply wiring line for initialization does not need to be additionally provided and thus the circuit can be simplified.

According to the second aspect of the present invention, by applying a potential that places the drive element in a conducting state to the data line and controlling the fourth switching element to a conducting state, a data potential is provided to the control terminal of the drive element and thus the drive element can always be set to a conducting state, regardless of a previous state of the pixel circuit. Hence, at the point in time when the third switching element is controlled to a conducting state, the drive element can be reliably set to a conducting state. Thus, when variations in the threshold voltage of the drive element are compensated for, the circuit can operate properly.

In addition, since the drive element can be initialized with any one of the third and fourth switching elements being maintained in a non-conducting state, the drive element can be initialized without connecting the first and second power supply wiring lines to the third power supply wiring line and thus the potential of the third power supply wiring line can always be stabilized. Furthermore, since initialization of the drive element is performed using the potential of the data line, a power supply wiring line for initialization does not need to be additionally provided and thus the circuit can be simplified. In addition, the number of wiring lines connected to the second electrode of the capacitor can be reduced and thus layout can be facilitated.

According to the third aspect of the present invention, during the first period, since a data potential is provided to the first and second electrodes of the capacitor, a potential difference held in the capacitor is zero. During the second period, the potential of the first electrode of the capacitor changes until the drive element is placed in a threshold state, and correspondingly, a potential difference held in the capacitor changes to a difference between the data potential and the threshold voltage of the drive element. During the third period, with the capacitor holding the above-described potential difference, the potential of the second electrode of the capacitor changes from the data potential to the potential of the third power supply wiring line. Hence, the potential of the control terminal of the drive element thereafter reaches a potential obtained by adding a difference between the potential of the third power supply wiring line and the data potential to a potential at which the drive element is placed in a threshold state. Therefore, the amount of current flowing through the drive element is not affected by the threshold voltage. In this manner, variations in the threshold voltage of the drive element can be compensated for.

During any of the first to third periods, the third and fourth switching elements are not placed in a conducting state at the same time. Accordingly, the first and second power supply wiring lines can be prevented from being connected to the third power supply wiring line and thus the potential of the third power supply wiring line can always be stabilized.

According to the fourth aspect of the present invention, during a selected scanning period for the pixel circuit, by controlling the fifth switching element to a non-conducting state, a current flowing through the electro-optical element from the drive element can be interrupted. Accordingly, the drive element can be properly set to a threshold state and unwanted light emission from the electro-optical element can be prevented.

According to the fifth aspect of the present invention, during a selected scanning period for the pixel circuit, by controlling the potential of the second power supply wiring line, a current can be prevented from flowing through the electro-optical element without providing a switching element between the first power supply wiring line and the second power supply wiring line. Accordingly, with a smaller amount of circuitry, the drive element can be properly set to a threshold state and unwanted light emission from the electro-optical element can be prevented.

According to the sixth aspect of the present invention, even when a potential at which the drive element can be reliably set to a conducting state is provided to the data line, by suitably adjusting the potential of the third power supply wiring line, the drive element can be controlled such that a desired amount of current flows therethrough. Hence, there is no need to additionally provide a power supply wiring line for initialization which is independent from the third power supply wiring line. Therefore, without increasing the number of wiring lines, the drive element can be initialized using a potential provided to the data line.

According to the seventh aspect of the present invention, an organic EL display that properly compensates for variations in the threshold voltage of a drive element can be obtained.

According to the eighth aspect of the present invention, by making the drive element and all the switching elements in the pixel circuit using thin-film transistors, the pixel circuit can be easily fabricated with high precision.

DESCRIPTION OF THE REFERENCE NUMERALS

Figure 1:
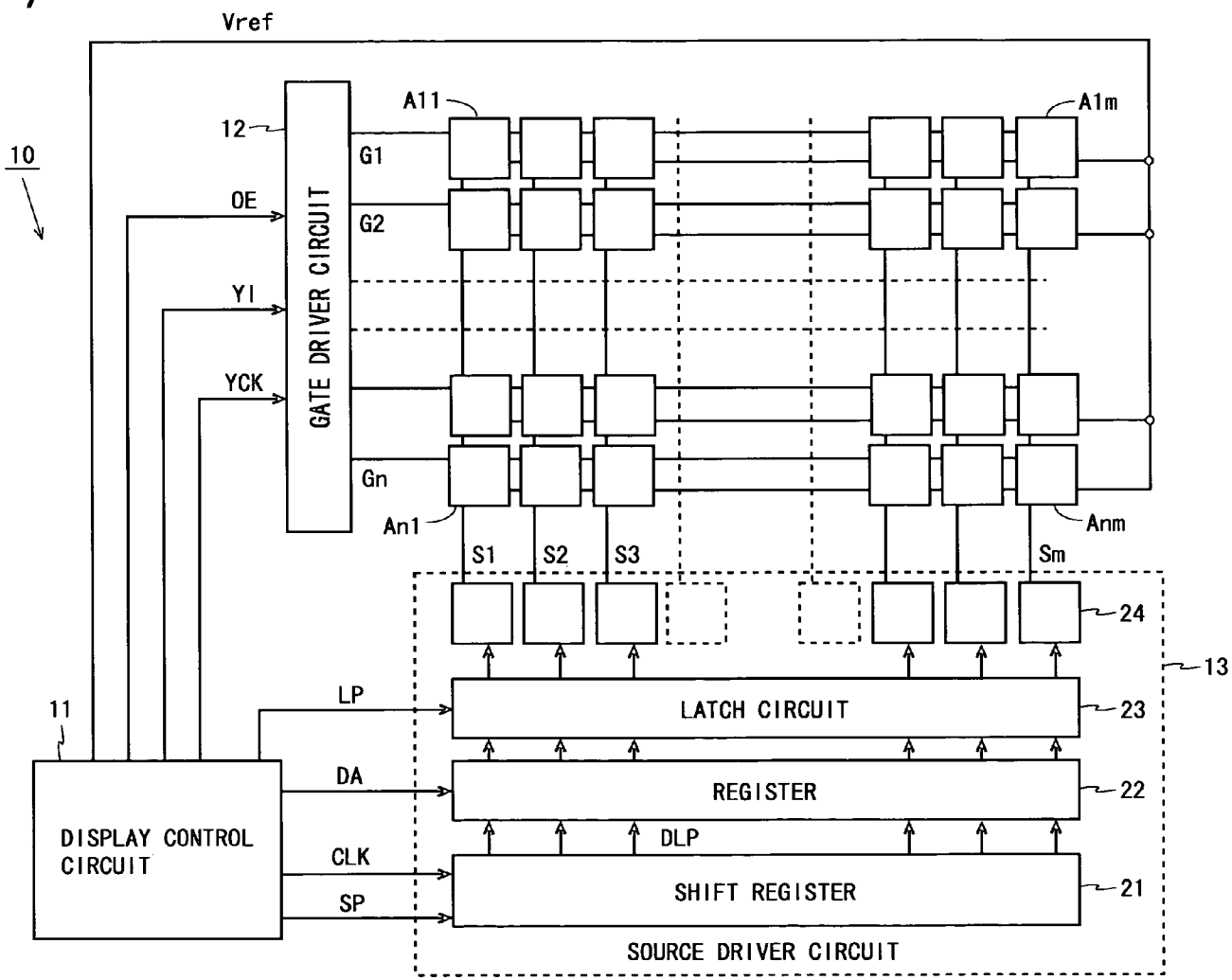
FIG. 1 is a block diagram showing a configuration of display devices according to first to third embodiments of the present invention.

10 Display device
11 Display control circuit
12 Gate driver circuit
13 Source driver circuit
21 Shift register
22 Register
23 Latch circuit
24 D/A converter
100, 200, and 300 Pixel circuit
110, 210, and 310 Driving TFT
111 to 115, 211 to 215, and 311 to 314 Switching TFT
120, 220, and 320 Capacitor
130, 230, and 330 Organic EL element

BEST MODE FOR CARRYING OUT THE INVENTION

Display devices according to first to third embodiments of the present invention will be described below with reference to FIGS. 1 to 6. The display devices according to the embodiments include a pixel circuit including an electro-optical element, a drive element, a capacitor, and a plurality of switching elements. The pixel circuit includes an organic EL element as the electro-optical element and includes thin-film transistors (TFTs) as the drive element and the switching elements. Note that the drive element and the switching elements can be made of, for example, amorphous silicon TFTs, low-temperature polysilicon TFTs, or CG silicon TFTs. By making the drive element and the switching elements using TFTs, the pixel circuit can be easily fabricated with high precision.

FIG. 1 is a block diagram showing a configuration of display devices according to the first to third embodiments of the present invention. A display device 10 shown in FIG. 1 includes a plurality of pixel circuits Aij (i is an integer between 1 and n inclusive and j is an integer between 1 and m inclusive), a display control circuit 11, a gate driver circuit 12, and a source driver circuit 13. In the display device 10, a plurality of scanning lines Gi parallel to one another and a plurality of data lines Sj parallel to one another and intersecting perpendicularly with the scanning lines Gi are provided. The pixel circuits Aij are arranged in a matrix at their respective corresponding intersections of the scanning lines Gi and the data lines Sj.

In addition to the above, in the display device 10, a plurality of control lines AZi and Ri (not shown) parallel to each other are arranged in parallel to the scanning lines Gi. The scanning lines Gi and the control lines AZi and Ri are connected to the gate driver circuit 12, and the data lines Sj are connected to the source driver circuit 13. The gate driver circuit 12 and the source driver circuit 13 function as drive circuits for the pixel circuits Aij. In addition, all the pixel circuits Aij are connected to a reference supply wiring line Vref. Furthermore, although not shown in FIG. 1, in a region where a pixel circuit Aij is arranged, a power supply wiring line Vp and a common cathode Vcom (or a cathode wiring line CAi) are arranged to supply a power supply voltage to the pixel circuit Aij.

The display control circuit 11 outputs a timing signal OE, a start pulse Y1, and a clock YCK to the gate driver circuit 12, outputs a start pulse SP, a clock CLK, display data DA, and a latch pulse LP to the source driver circuit 13, and outputs a predetermined reference potential Vstd to the reference supply wiring line Vref.

The gate driver circuit 12 includes a shift register circuit, a logic operation circuit, and a buffer (none of which are shown). The shift register circuit sequentially transfers the start pulse Y1 in synchronization with the clock YCK. The logic operation circuit performs a logic operation between a pulse outputted from each stage of the shift register circuit and the timing signal OE. An output from the logic operation circuit is provided to corresponding scanning line Gi, control lines AZi, Ri, and the like, through the buffer. The gate driver circuit 12 thus functions as a scanning signal output circuit that selects a write-target pixel circuit using a corresponding scanning line Gi.

The source driver circuit 13 includes an m-bit shift register 21, a register 22, a latch circuit 23, and m D/A converters 24. The shift register 21 includes m cascade-connected one-bit registers. The shift register 21 sequentially transfers the start pulse SP in synchronization with the clock CLK and outputs timing pulses DLP from the registers of the respective stages. In accordance with output timing of the timing pulses DLP, display data DA is supplied to the register 22. The register 22 stores the display data DA according to the timing pulses DLP. When display data DA for one row is stored in the register 22, the display control circuit 11 outputs a latch pulse LP to the latch circuit 23. When the latch circuit 23 receives the latch pulse LP, the latch circuit 23 holds the display data stored in the register 22. The D/A converters 24 are provided to the respective data lines Sj on a one-to-one basis. The D/A converters 24 convert the display data held in the latch circuit 23 to analog signal voltages and provide the analog signal voltages to corresponding data lines Sj. The source driver circuit 13 thus functions as a display signal output circuit that provides potentials according to display data to corresponding data lines Sj.

In order for the display device 10 to achieve miniaturization and a reduction in cost, it is preferred that all or part of the gate driver circuit 12 and the source driver circuit 13 be formed on the same substrate as that for the pixel circuits Aij, using CG silicon TFTs, polycrystal silicon TFTs, and the like.

The pixel circuits Aij included in the display devices according to the embodiments will be described in detail below. In the following description, a high-level potential provided to a gate terminal of a switching TFT is referred to as GH and a low-level potential is referred to as GL.

First Embodiment

Figure 2:
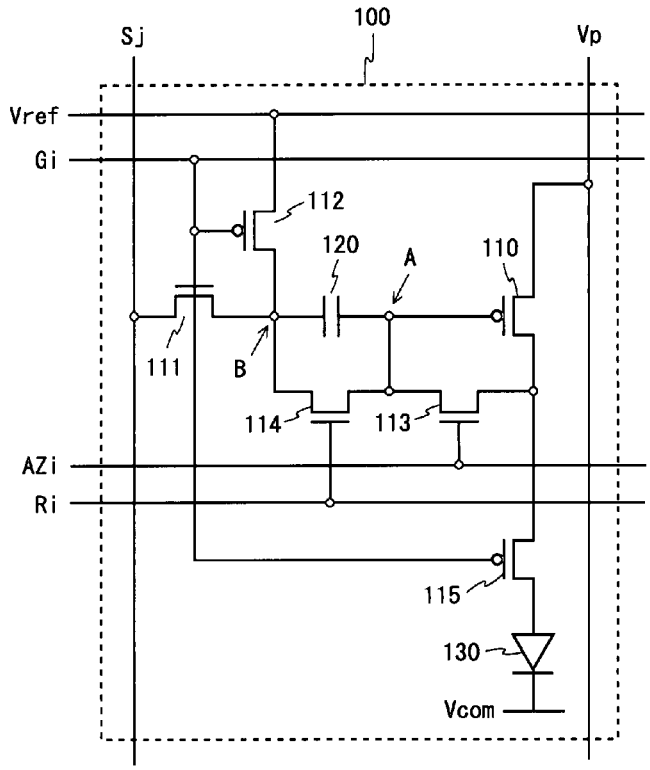
FIG. 2 is a circuit diagram of a pixel circuit included in a display device according to the first embodiment of the present invention.

FIG. 2 is a circuit diagram of a pixel circuit included in a display device according to a first embodiment of the present invention. A pixel circuit 100 shown in FIG. 2 includes a driving TFT 110, switching TFTs 111 to 115, a capacitor 120, and an organic EL element 130. The switching TFTs 111, 113, and 114 are of an n-channel type and other TFTs are of a p-channel type.

The pixel circuit 100 is connected to a power supply wiring line Vp, a reference supply wiring line Vref, a common cathode Vcom, a scanning line Gi, control lines AZi and Ri, and a data line Sj. Among them, the power supply wiring line Vp (first power supply wiring line) and the common cathode Vcom (second power supply wiring line) are respectively applied with fixed potentials VDD and VSS, and the reference supply wiring line Vref (third power supply wiring line) is applied with a reference potential Vstd. The common cathode Vcom serves as a common electrode for all organic EL elements 130 in the display device.

In the pixel circuit 100, the driving TFT 110, the switching TFT 115, and the organic EL element 130 are provided in series on a path connecting the power supply wiring line Vp to the common cathode Vcom, in order from the side of the power supply wiring line Vp. One electrode of the capacitor 120 is connected to a gate terminal of the driving TFT 110. The switching TFT 111 is provided between the other electrode of the capacitor 120 and the data line Sj. Hereinafter, a connection point between the driving TFT 110 and the capacitor 120 is referred to as A and a connection point between the capacitor 120 and the switching TFT 111 is referred to as B. The switching TFT 112 is provided between the connection point B and the reference supply wiring line Vref, the switching TFT 113 is provided between the connection point A and a drain terminal of the driving TFT 110, and the switching TFT 114 is provided between the connection point A and the connection point B.

Gate terminals of the respective switching TFTs 111, 112, and 115 are connected to the scanning line Gi, a gate terminal of the switching TFT 113 is connected to the control line AZi, and a gate terminal of the switching TFT 114 is connected to the control line Ri. The potentials of the scanning line Gi and the control lines AZi and Ri are controlled by the gate driver circuit 12 and the potential of the data line Sj is controlled by the source driver circuit 13.

Figure 3:
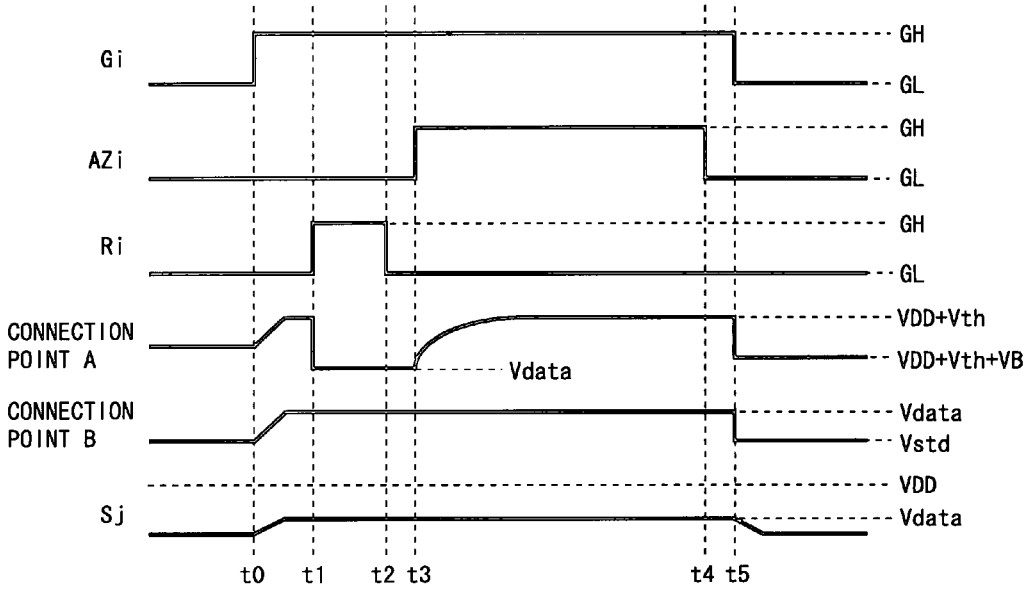
FIG. 3 is a timing chart of the pixel circuit shown in FIG. 2.

FIG. 3 is a timing chart of the pixel circuit 100. FIG. 3 shows changes in potentials applied to the scanning line Gi, the control lines AZi and Ri, and the data line Sj and changes in potentials at the connection points A and B. In FIG. 3, a period from time t0 to time t5 corresponds to one horizontal scanning period. With reference to FIG. 3, the operation of the pixel circuit 100 will be described below.

Before time t0, the potentials of the scanning line Gi and the control lines AZi and Ri are controlled to GL (low level) and the potential of the data line Sj is controlled to a level according to previous display data (display data written to a pixel circuit scanned in a previous row). Hence, the switching TFTs 112 and 115 are placed in a conducting state and the switching TFTs 111, 113, and 114 are placed in a non-conducting state. The potential at the connection point A reaches a potential according to display data written to the pixel circuit 100 last time and the potential at the connection point B reaches Vstd.

When at time t0 the potential of the scanning line Gi changes to GH, the switching TFT 111 changes to a conducting state and the switching TFTs 112 and 115 change to a non-conducting state. Since, while the potential of the scanning line Gi is GH (during a period from time t0 to time t5), the switching TFT 115 is in a non-conducting state, a current does not flow through the organic EL element 130 and thus the organic EL element 130 does not emit light.

While the potential of the scanning line Gi is GH, the potential of the data line Sj is controlled to a level potential according to present display data (hereinafter, referred to as data potential Vdata). Specifically, data potential Vdata which is constant during a selected scanning period is applied to the data line Sj. During this period, the connection point B is connected to the data line Sj through the switching TFT 111, and thus, the potential at the connection point B reaches Vdata. During a period from time t0 to time t1, since the switching TFTs 113 and 114 are in a non-conducting state, when the potential at the connection point B changes from Vstd to Vdata, the potential at the connection point A also changes by the same amount (Vdata−Vstd).

Then, when at time t1 the potential of the control line Ri changes to GH, the switching TFT 114 changes to a conducting state. Accordingly, the connection point A and the connection point B are connected to each other. Since the connection point A is connected to the data line Sj through the switching TFTs 111 and 114, the potential at the connection point A also changes to Vdata and a potential difference held in the capacitor 120 is zero.

The data potential Vdata is determined based on the characteristics of the driving TFT 110, the reference potential Vstd, and display data. The data potential Vdata is also determined within a range in which the driving TFT 110 is placed in a conducting state when the data potential Vdata is applied to the connection point A (the gate terminal of the driving TFT 110). Therefore, after time t1, the driving TFT 110 is always placed in a conducting state. Note that even when the driving TFT 110 is placed in a conducting state, while the switching TFT 115 is in a non-conducting state (i.e., while the potential of the scanning line Gi is GH), a current does not flow through the organic EL element 130 and thus the organic EL element 130 does not emit light.

Then, when at time t2 the potential of the control line Ri changes to GL, the switching TFT 114 changes to a non-conducting state. The connection point A is thus disconnected from the data line Sj and thus the potential at the connection point A is temporarily fixed at Vdata.

Then, when at time t3 the potential of the control line AZi changes to GH, the switching TFT 113 changes to a conducting state. The gate and drain terminals of the driving TFT 110 are thus short-circuited, whereby the driving TFT 110 establishes a diode connection. During a period from time t1 to time t2, a data potential Vdata is applied to the connection point A and even after time t3 the potential at the connection point A is maintained at Vdata by the capacitor 120. Therefore, at time t3, the driving TFT 110 is reliably in a conducting state.

After time t3, a current flows into the connection point A from the power supply wiring line Vp through the driving TFT 110 and the switching TFT 113, and the potential at the connection point A (a gate terminal potential of the driving TFT 110) rises while the driving TFT 110 is in a conducting state. The driving TFT 110 changes to a non-conducting state when the gate-source voltage thereof reaches a threshold voltage Vth (a negative value for the driving TFT 110 of a p-channel type). Therefore, the potential at the connection point A rises to (VDD+Vth) and the driving TFT 110 is placed in a threshold state (a state in which the gate-source potential difference is equal to the threshold voltage Vth).

Then, when at time t4 the potential of the control line AZi changes to GL, the switching TFT 113 changes to a non-conducting state. At this time, a potential difference (VDD+Vth−Vdata) between the connection points A and B is held in the capacitor 120.

Then, when at time t5 the potential of the scanning line Gi changes to GL, the switching TFTs 112 and 115 change to a conducting state and the switching TFT 111 changes to a non-conducting state. The connection point B is thus disconnected from the data line Sj and is connected to the reference supply wiring line Vref through the switching TFT 112. Hence, the potential at the connection point B changes from Vdata to Vstd and the potential at the connection point A also correspondingly changes by the same amount (Vstd−Vdata; hereinafter, referred to as VB) and reaches (VDD+Vth+VB).

After time t5, since the switching TFT 115 is in a conducting state, a current flows through the organic EL element 130 from the power supply wiring line Vp through the driving TFT 110 and the switching TFT 115. Although the amount of current flowing through the driving TFT 110 increases or decreases depending on the gate terminal potential (VDD+Vth+VB), since a process of compensating for variations in the threshold voltage Vth of the driving TFT 110 is performed during a period from time t3 to time t4, a current according to the potential difference VB (=Vstd−Vdata) flows through the driving TFT 110. Therefore, regardless of the value of the threshold voltage Vth of the driving TFT 110, an amount of current according to the difference (Vstd−Vdata) between the reference potential and the data potential flows through the organic EL element 130 and thus the organic EL element 130 emits light with a specified luminance.

In the above-described operation, after the switching TFT 114 changes to a non-conducting state at time t2, at time t3 the switching TFT 113 changes to a conducting state. Accordingly, a current can be prevented from flowing into the reference supply wiring line Vref from the power supply wiring line Vp through the driving TFT 110 and the switching TFTs 112 to 114, enabling to stably maintain the reference potential Vstd.

In addition, in the above-described operation, after the switching TFT 113 changes to a non-conducting state at time t4, at time t5 the switching TFT 111 changes to a non-conducting state and the switching TFT 112 changes to a conducting state. Accordingly, a current can be prevented from flowing into the connection point A from the power supply wiring line Vp through the driving TFT 110 and the switching TFT 113, enabling to accurately hold the gate terminal potential of the driving TFT 110.

Furthermore, by setting the data potential Vdata to be lower than (VDD+Vth) (i.e., VDD+Vth>Vdata), the driving TFT 110 can always be set to a conducting state during a period from time t1 to time t3. Generally, when a current flowing through a TFT is controlled, since a gate potential is uniquely determined according to the characteristics of the TFT and the potential of a source power supply, the absolute value of a data potential is fixedly determined. On the other hand, in the pixel circuit 100, a gate potential of the driving TFT 110 is determined by the data potential Vdata and the reference potential Vstd and an amount of current flowing through the organic EL element 130 is determined by the difference therebetween (Vstd−Vdata).

Hence, in the pixel circuit 100, regardless of the characteristics of the driving TFT 110, the data potential Vdata and the reference potential Vstd can be freely selected within a range in which each switching TFT can be controlled. Therefore, even when a potential at which the driving TFT 110 can be reliably set to a conducting state is selected as the data potential Vdata, by suitably adjusting the reference potential Vstd the driving TFT 110 can be controlled such that a desired amount of current flows therethrough. Hence, there is no need to provide a power supply wiring line for initialization which is independent from the reference supply wiring line Vref. Accordingly, without increasing the number of wiring lines, the driving TFT 110 can be initialized using the data potential Vdata and thus the circuit can be simplified.

As described above, according to the display device according to the present embodiment, by applying a data potential Vdata that places the driving TFT 110 in a conducting state to the data line Sj and controlling the switching TFTs 111 and 114 to a conducting state, the data potential Vdata is provided to the gate terminal of the driving TFT 110 and thus the driving TFT 110 can always be set to a conducting state, regardless of a previous state of the pixel circuit.

Therefore, when the switching TFT 113 is controlled to a conducting state thereafter and the switching TFTs 114 and 115 are controlled to a non-conducting state, the driving TFT 110 can be reliably set to a threshold state and a current flowing through the organic EL element 130 from the driving TFT 110 can be interrupted. Accordingly, the driving TFT 110 can be properly set to a threshold state and unwanted light emission from the organic EL element 130 can be prevented. When unwanted light emission can be prevented, the contrast of a display screen improves and the life of the organic EL element 130 extends.

Furthermore, by always placing any one of the switching TFTs 113 and 114 in a non-conducting state, the power supply wiring line Vp and the reference supply wiring line Vref can be prevented from being connected to each other and accordingly the reference potential Vstd can always be stabilized. In this manner, the luminances of other pixel circuits can be prevented from fluctuating due to a compensation operation performed on a certain pixel circuit 100 and thus display quality can be enhanced.

Second Embodiment

Figure 4:
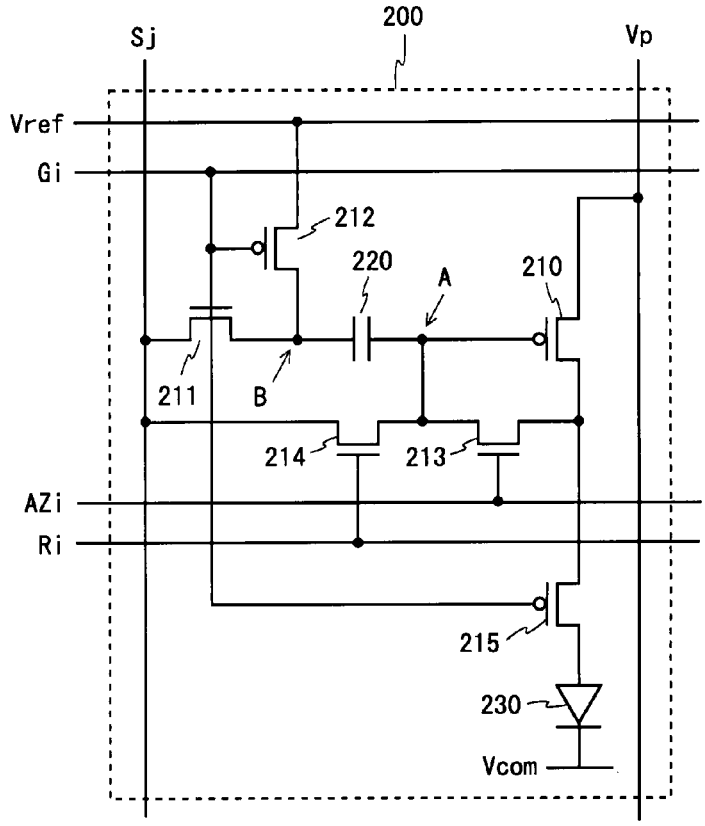
FIG. 4 is a circuit diagram of a pixel circuit included in a display device according to the second embodiment of the present invention.

FIG. 4 is a circuit diagram of a pixel circuit included in a display device according to a second embodiment of the present invention. A pixel circuit 200 shown in FIG. 4 includes a driving TFT 210, switching TFTs 211 to 215, a capacitor 220, and an organic EL element 230. The switching TFTs 211, 213, and 214 are of an n-channel type and other TFTs are of a p-channel type.

In a pixel circuit 100 (FIG. 2), a switching TFT 114 is provided between a connection point A and a connection point B. On the other hand, in the pixel circuit 200, the switching TFT 214 is provided between a connection point A and a data line Sj. Except for this point, the configuration of the pixel circuit 200 is the same as that of the pixel circuit 100. As with the pixel circuit 100, the pixel circuit 200 is connected to a power supply wiring line Vp, a reference supply wiring line Vref, a common cathode Vcom, a scanning line Gi, control lines AZi and Ri, and the data line Sj. The same potentials as those for the pixel circuit 100 are applied to these signal lines (see FIG. 3) and the pixel circuit 200 operates in the same manner as the pixel circuit 100.

According to a display device including pixel circuits 200, the same effects as those obtained by a display device including pixel circuits 100 can be obtained. In addition, although in a pixel circuit 100 wiring lines concentrate at a connection point B and thus layout may become difficult, according to a pixel circuit 200 the number of wiring lines connected to a connection point B can be reduced and thus layout can be facilitated.

Third Embodiment

Figure 5:
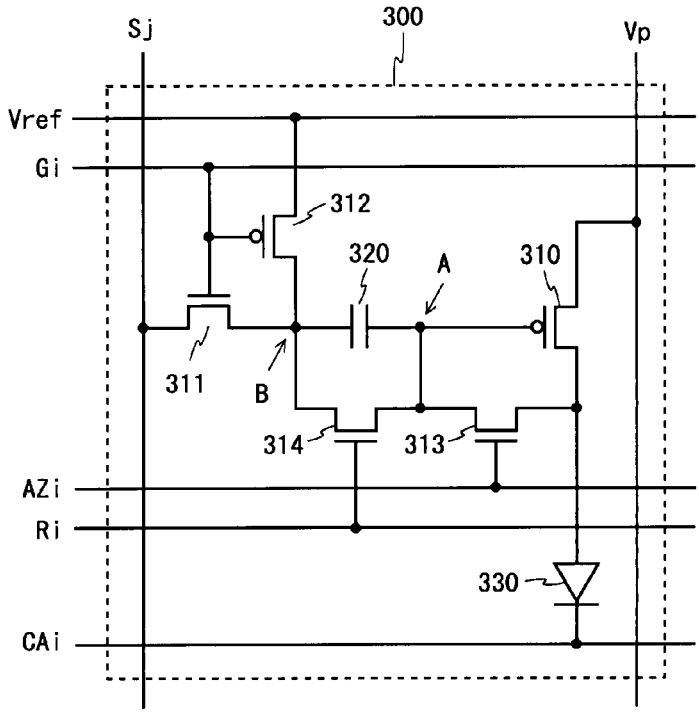
FIG. 5 is a circuit diagram of a pixel circuit included in a display device according to the third embodiment of the present invention.

FIG. 5 is a circuit diagram of a pixel circuit included in a display device according to a third embodiment of the present invention. A pixel circuit 300 shown in FIG. 5 includes a driving TFT 310, switching TFTs 311 to 314, a capacitor 320, and an organic EL element 330. The switching TFTs 311, 313, and 314 are of an n-channel type and other TFTs are of a p-channel type.

The pixel circuit 300 differs from a pixel circuit 100 (FIG. 2) in the following points. In the pixel circuit 300, a cathode terminal of the organic EL element 330 is connected to a cathode wiring line CAi instead of a common cathode Vcom. The pixel circuit 300 does not include a TFT corresponding to a switching TFT 115, and the driving TFT 310 is directly connected to the organic EL element 330. The potential of the cathode wiring line CAi is individually controlled by a power supply switching circuit (not shown) included in a display device 10. The pixel circuit 300 is connected to a power supply wiring line Vp, a reference supply wiring line Vref, the cathode wiring line CAi, a scanning line Gi, control lines AZi and Ri, and a data line Sj.

Figure 6:
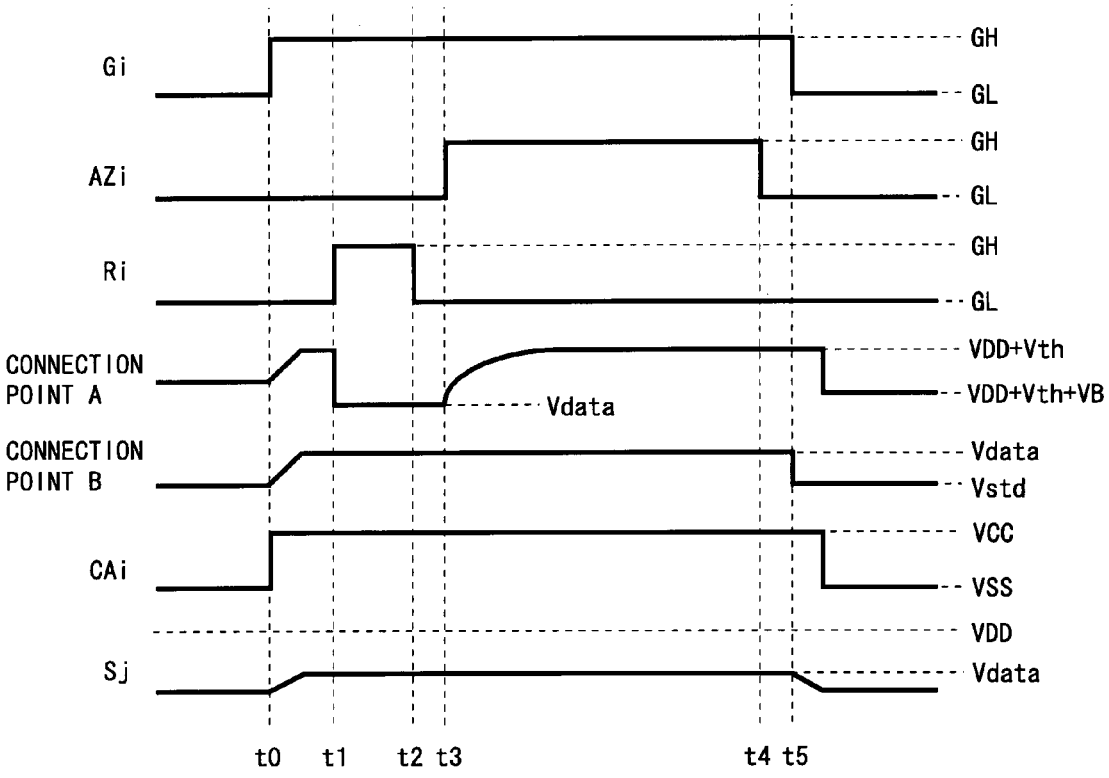
FIG. 6 is a timing chart of the pixel circuit shown in FIG. 5.
Figure 7:
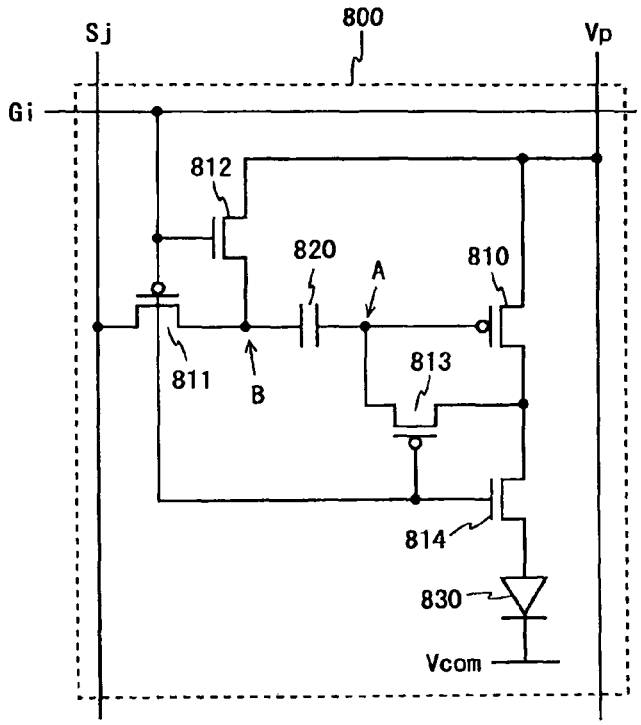
Fig. 7 PRIOR ART
FIG. 7 is a circuit diagram of a pixel circuit (first example) included in a conventional display device.
Figure 8:
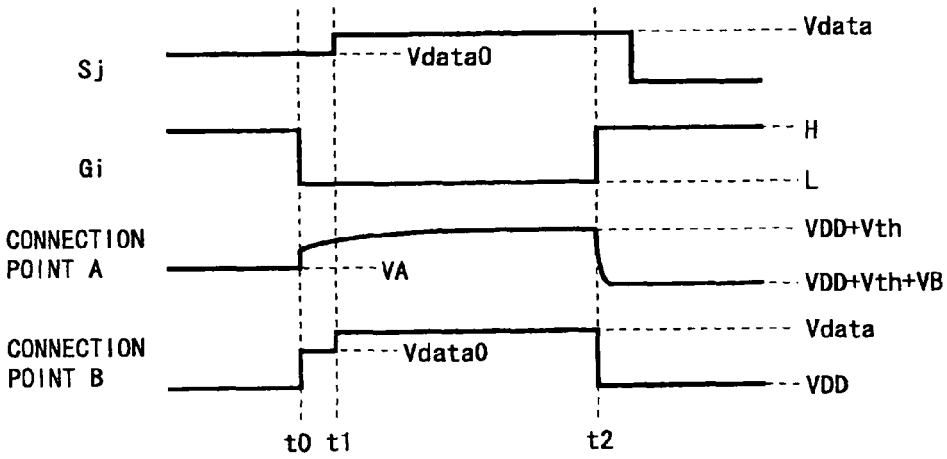
PRIOR ART Fig. 8
FIG. 8 is a timing chart of the pixel circuit shown in FIG. 7.
Figure 9:
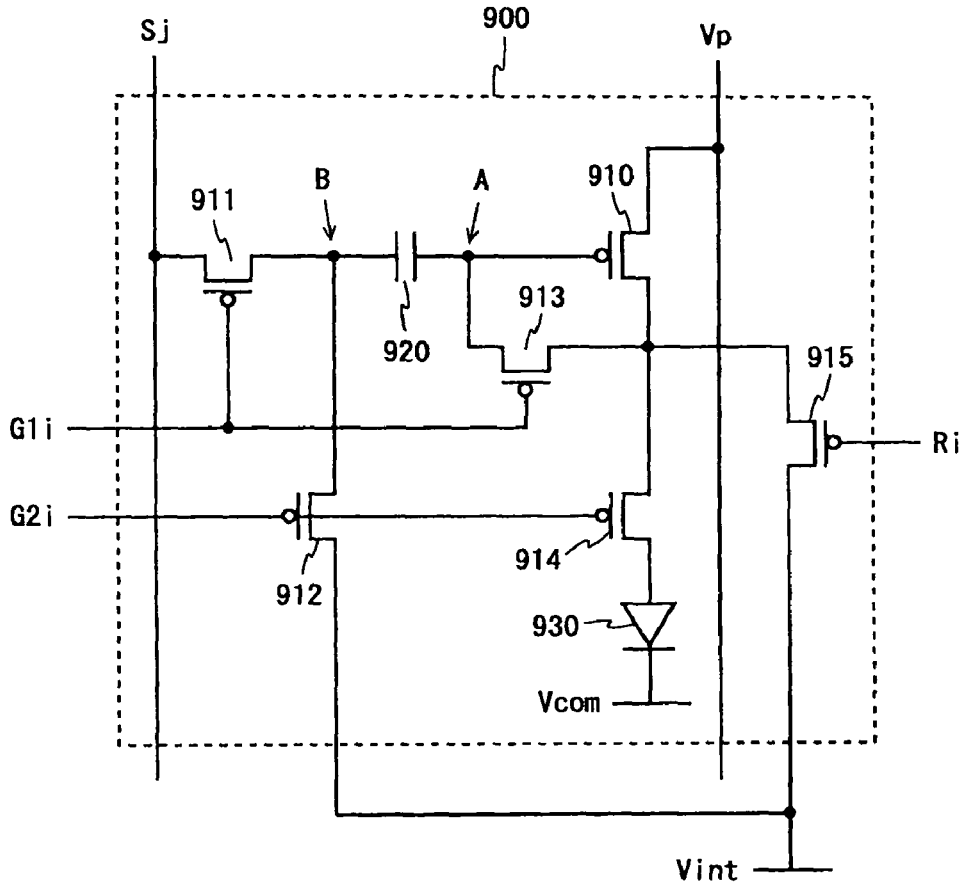
Fig. 9 PRIOR ART
FIG. 9 is a circuit diagram of a pixel circuit (second example) included in a conventional display device.

FIG. 6 is a timing chart of the pixel circuit 300. FIG. 6 shows changes in potentials applied to the scanning line Gi, the control lines AZi and Ri, the cathode wiring line CAi, and the data line Sj and changes in potentials at connection points A and B. In FIG. 6, a period from time t0 to time t5 corresponds to one horizontal scanning period. The potentials shown in FIG. 6 change in the same manner as in FIG. 3, except the potential of the cathode wiring line CAi.

As shown in FIG. 6, the potential of the cathode wiring line CAi is controlled to a predetermined level VCC during a period from time t0 to time t5 and is controlled to VSS during other times. The potential VCC is determined such that a voltage applied to the organic EL element 330 is lower than a light-emission threshold voltage of the organic EL element 330 when a potential VDD is applied to one end of a circuit in which the driving TFT 310 and the organic EL element 330 are connected to each other in series, and the potential VCC is applied to the other end. Hence, while the potential of the cathode wiring line CAi is VCC (during a period from time t0 to time t5), a current contributing to light emission does not flow through the organic EL element 330 and thus the organic EL element 330 does not emit light. Except for the above point, the operation of the pixel circuit 300 is the same as that of the pixel circuit 100.

In this manner, in the display device according to the present embodiment, during a selected scanning period for a pixel circuit, the potential of the cathode wiring line CAi is controlled to a level at which a current does not flow through the organic EL element 330. Therefore, without providing a switching TFT on a path connecting the power supply wiring line Vp to the cathode wiring line CAi, the same effects as those obtained by the first embodiment can be obtained.

As described above, according to display devices according to the embodiments of the present invention, variations in the threshold voltage of a driving TFT can be properly compensated for and unwanted light emission from an organic EL element can be prevented, and the luminances of other pixel circuits can be prevented from fluctuating due to a threshold voltage compensation operation performed on a certain pixel circuit and accordingly display quality can be improved. Moreover, the present invention is not limited to the embodiments and the features of the embodiments can also be appropriately combined.

Although a driving TFT of a p-channel type is used in all of the embodiments, a driving TFT of an n-channel type can also be used by appropriately adjusting the potentials of a scanning line and control lines, a power supply voltage, and a data potential. Likewise, for switching TFTs, TFTs of opposite polarity can also be used.

INDUSTRIAL APPLICABILITY

Display devices of the present invention obtain the effects of being able to properly compensate for variations in the threshold voltage of a drive element and to prevent the luminances of other pixel circuits from fluctuating due to a threshold voltage compensation operation performed on a certain pixel circuit, and thus, can be used as various types of display devices including current-driven display elements such as organic EL displays.

The invention claimed is:

1. A current-driven display device comprising:

a plurality of pixel circuits arranged at respective intersections of a plurality of scanning lines and a plurality of data lines;

a scanning signal output circuit that selects a write-target pixel circuit using a corresponding scanning line; and a display signal output circuit that provides a potential according to display data to a corresponding data line, wherein each of the pixel circuits includes:

an electro-optical element provided between a first power supply wiring line and a second power supply wiring line;

a drive element provided in series with the electro-optical element and between the first power supply wiring line and the second power supply wiring line;

a capacitor connected, at a first electrode thereof, to a control terminal of the drive element;

a first switching element provided between a second electrode of the capacitor and a corresponding data line;

a second switching element provided between the second electrode of the capacitor and a third power supply wiring line;

a third switching element provided between the control terminal and one current input/output terminal of the drive element; and a fourth switching element directly connected, at one end thereof, to the control terminal of the drive element and directly connected, at the other end thereof, to the second electrode of the capacitor.

2. The display device according to claim 1, wherein in a selected scanning period for the pixel circuit, during a first period, the first and the fourth switching elements are controlled to a conducting state and the second and the third switching elements are controlled to a non-conducting state, then, during a second period, the first and the third switching elements are controlled to a conducting state and the second and the fourth switching elements are controlled to a non-conducting state, and then, during a third period, the first, the third, and the fourth switching elements are controlled to a non-conducting state and the second switching element is controlled to a conducting state.

3. The display device according to claim 1, wherein each of the pixel circuits further includes a fifth switching element provided between the drive element and the electro-optical element.

4. The display device according to claim 1, wherein during a selected scanning period for the pixel circuit, a potential of the second power supply wiring line is controlled such that a voltage applied to the electro-optical element is lower than a light-emission threshold voltage.

5. The display device according to claim 1, wherein a potential at which the drive element can be set to a conducting state and which is constant during a selected scanning period for the pixel circuit is provided to the data line.

6. The display device according to claim 1, wherein the electro-optical element is made of an organic EL element.

7. The display device according to claim 1, wherein the drive element and all the switching elements in each of the pixel circuits are made of thin-film transistors.

* * * * *